US006555962B1

(12) United States Patent
Jackson et al.

(10) Patent No.: US 6,555,962 B1
(45) Date of Patent: Apr. 29, 2003

(54) CERAMIC METAL HALIDE LAMP HAVING MEDIUM ASPECT RATIO

(75) Inventors: Andrew D. Jackson, Bath, NY (US); Ray G. Gibson, Bath, NY (US); Sarah Carleton, Hammondsport, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/527,286

(22) Filed: Mar. 17, 2000

(51) Int. Cl.[7] ..... H01J 61/30; H01J 17/16

(52) U.S. Cl. ..... 313/623; 313/638; 313/643

(58) Field of Search ..... 313/623, 637, 313/638, 639, 326, 634, 493, 641, 642, 643

(56) References Cited

U.S. PATENT DOCUMENTS

| | | | | |
|---|---|---|---|---|
| 4,203,049 A | | 5/1980 | Kuus | 313/174 |
| 4,409,517 A | | 10/1983 | Van der Sande et al. | 313/631 |
| 4,910,432 A | | 3/1990 | Brown et al. | 313/620 |
| 5,751,111 A | | 5/1998 | Stoffels et al. | 313/606 |
| 5,923,127 A | | 7/1999 | Keijser et al. | 315/224 |
| 5,973,453 A | * | 10/1999 | Van Vliet et al. | 313/623 |
| 6,031,332 A | | 2/2000 | Wijenberg et al. | 313/637 |
| 6,300,729 B1 | * | 10/2001 | Keijser et al. | 313/638 |

* cited by examiner

*Primary Examiner*—Sandra O'Shea
*Assistant Examiner*—Bao Truong
(74) *Attorney, Agent, or Firm*—Ernestine C. Bartlett

(57) ABSTRACT

A metal halide lamp has a ceramic discharge vessel with an inside length L, an inside diameter D, and an aspect ratio L/D of between 3 and 5. The fill gas includes xenon, mercury, sodium halide, and halides of rare earth metals. Hydrogen iodide voltage spikes during start-up are related to product of volume and the cold xenon pressure, which are adjusted to limit the spikes. Voltage crest factor is related to the product of total operating pressure and the square of the inside diameter, which are adjusted to limit the crest factor. The ceramic discharge metal halide (CDM)lamp may have a power rating of 200 W or more and can be used with an existing ballast for a high pressure sodium (HPS) lamp of like power rating.

10 Claims, 6 Drawing Sheets

| WATTS | ID | IL | Hg(mg) | Pxe Torr | WALL THK. | Vcf | ttb,mm | Lm/W | CRI | CCT,K | MPCD |
|---|---|---|---|---|---|---|---|---|---|---|---|
| 200 | 7.4 | 30 | 2.8 | 200 | 0.8 | 1.4 | 2 | 91 | 88 | 4340 | 8.7 |
| 200 | 7.4 | 26 | 2.9 | 200 | 0.95 | 1.5 | 2 | 91 | 92 | 4200 | 0 |
| 400 | 9.2 | 40 | 3.8 | 100 | 1.1 | 1.5 | 3 | 95 | 96 | 4150 | 0 |

FIG. 6

CERAMIC METAL HALIDE LAMP HAVING MEDIUM ASPECT RATIO

BACKGROUND OF THE INVENTION

The present invention relates to an electric lamp having a ceramic discharge vessel enclosing a discharge space having a length L, a diameter D, and an aspect ratio L/D; a fill gas including xenon, mercury, sodium halide, and halides of rare earth metals; and a pair of electrodes for maintaining a discharge in the fill gas.

High wattage (over 150 W) metal halide lamps are presently available only with quartz discharge vessels, which are larger than ceramic vessels and have a lower (−200° C.) wall temperature. A smaller vessel is desirable because the smaller discharge vessel better approximates a point source. Higher temperatures are desirable to achieve a higher cold spot temperature $T_C$ on the vessel wall; this increases the vapor pressure of the salts in the fill gas. The term "ceramic" as used herein means metal oxide, such as sapphire or polycrystalline alumina (PCA), as well as nitrides such as AlN.

U.S. Pat. No. 5,973,453 discloses a ceramic discharge metal halide (CDM) lamp wherein EA/D>5, EA being the distance between electrode tips, the tips being spaced from the endwalls of the discharge space. The ionizable filling includes Xe as an ignition gas, and NaI and $CeI_3$ in a molar ratio between 3:1 and 7:1. In an embodiment having a rated power of 150 W and intended as a retrofit for a high pressure sodium installation operating at 80–100 volts, EA/D=8, the fill includes Hg, and the Xe fill pressure is 250 mbar (187 torr). This yields a color rendering index (CRI) of 58 at a color temperature of 3900° K., and a luminous efficacy of 130 lm/W. It is noted that a comparable HPS lamp has a lower luminous efficacy (110 lm/W) and considerably lower CRI (21), while a comparable high pressure mercury lamp has comparable CRI but much lower efficacy (60 lm/W).

In another 150 W embodiment disclosed in U.S. Pat. No. 5,973,453, the fill is free of mercury and the lamp is operated at 45 V, so it is not suited as a retrofit for HPS. The Xe fill pressure is 1250 mbar (938 torr), the efficacy is 145 lm/W, and the CRI is 53. In a 185 W embodiment, the lamp voltage is 53 V, the Xe fill pressure is 500 mbar (375 torr), and the CRI is 61. All embodiments use a ceramic tube with a wall thickness of 1.4 mm. All Hg-free embodiments are operated on a square wave voltage generated by an electronic ballast.

While U.S. Pat. No. 5,973,453 discloses a CDM lamp with high efficacy, and even suggests a possible retrofit for an HPS ballast, the color rendering is still less than desirable and would not be suitable for many applications.

U.S. Pat. No. 6,031,332 discloses a CDM lamp having a CRI over 90, and achieves a limited voltage crest factor, so that the lamp achieves a long useful life. Voltage crest factor $V_{CF}$ is the ratio of the reignition voltage to the arc voltage, i.e. the operating voltage. The reignition voltage is the voltage required to reignite the discharge when it extinguishes as the polarity of an AC supply voltage changes. $V_{CF}$ assumes a high value in particular when the lamp is operated on a sinusoidal voltage, which is typical of a magnetic ballast, and usually increases during lamp life.

U.S. Pat. No. 6,031,332 addresses the problem of increasing reignition voltage by including calcium iodide in the fill to a molar quantity of 30 to 50% of the total molar quantity of halides. The ratio EA/D is less than 1.0 and L/D is slightly greater than 1.0; the fill includes argon at a pressure of 140 mbar (105 torr) as the ignition gas. The lamp operates at 80 to 100 V but the power is only 70 W; as such it would not be suitable for retrofit in an HPS installation.

A well known problem in metal halide lamps is the occurrence of hydrogen iodide voltage spikes. HI spikes occur during run-up of metal halide lamps that have hydrogen contamination in the presence of free iodide. Typically, the hydrogen comes from water that is present in the fill gas, but it can also be present on the lamp parts and the salts. Special precautions are required to insure that the $H_2O$ level inside the arc tube is as low as possible, preferably less than 0.5% of the fill gas.

One method to eliminate the HI spikes is given in U.S. Pat. No. 4,409,517, which discloses the use of Nb as a window to allow the rapid diffusion of $H_2$ out of the arc tube. U.S. Pat. No. 4,203,049 discloses a getter for the hydrogen.

The prior art does not disclose a high wattage CDM lamp with good color rendering, high efficacy, and high lumen maintenance which would be suitable for use with an existing magnetic ballast for an HPS lamp.

SUMMARY OF THE INVENTION

It is a primary object of the invention to provide a high wattage (over 150 W) CDM lamp which can be used with a magnetic ballast which was designed for use with a high pressure sodium (HPS) lamp. It is a related object to provide a CDM lamp which limits hydrogen iodide voltage spikes so they are within the voltage supplied by the ballast.

It is a further object to provide a CDM lamp which has a low voltage crest factor so that flicker is eliminated and long life is achieved using an HPS ballast.

It is a further object to determine a design space for the lamp that is within established material limits while providing the desired lamp efficacy and color properties.

These and other objects are achieved in a CDM lamp using xenon as a starting gas and having an aspect ratio in the range of 3 to 5. This is considered a medium aspect ratio, since most prior art CDM lamps have aspect ratios of about 1, and HPS lamps have aspect ratios on the order of 10.

The design space was determined by the use of designed experiments and the characteristic equations for each design parameter. FIG. 1 shows the design space that was found for a 200 W CDM lamp. Four curves were plotted. The curve on the lower left represents a voltage crest factor $V_{CF}$ of 1.7, and the space above it represents lower $V_{CF}$'s. This is desirable because ballasts for HPS lamps have low sustaining voltages. The next curve represents a wall temperature $T_W$ of 1250° C., and the space above it represents lower wall temperatures. This is desirable because at higher temperatures the PCA is attacked by the salts and also evaporates, which darkens the outer envelope and shortens lamp life. Next are two intersecting curves which define the actual design space. One is the curve for a cold spot temperature of 1005° C.; the space above it represents lower temperatures. The other represents an efficacy of 90 lm/W; the space below it represents higher efficacies. The design space is limited by an inside diameter of 6.7 mm and an inside length of 33 mm (aspect ratio 4.9), and, at an inside diameter of 8 mm, lengths of 25 mm (aspect ratio 3.1) and 30 mm (aspect ratio 3.8). Longer lengths may be possible.

The design space for the discharge tube is also limited by the need to reduce or eliminate hydrogen iodide voltage spikes. It was found that the level of HI spike voltage during the first run-up of the lamp is dependent on both the volume V of the arc tube and the cold fill pressure P of the starting gas (also called buffer or ignition gas). In a series of experiments with Xe as the gas, the minimum HI spike voltage was measured and plotted against the product of P and the volume, as shown in FIG. 4. A curve fit to the data is described by the equation $V_{HI}=33654\ PV^{-1.185}$, where P is in torr and V is in cubic centimeters. To minimize $H_2$ and $H_2O$ in these experiments, the arc tubes were made in an inert gas atmosphere dry box, the discharge tube was vacuum baked at 1300° for one hour, the electrodes were vacuum baked at elevated temperature, and the salts were contained in an inert gas atmosphere until dosed into the arc tube. In spite of these careful steps, HI spikes still form, but can be controlled by choice of P and V.

For a lamp to sustain on a ballast, the voltage spike must be below the available voltage supplied by the ballast. This voltage is typically 200 volts or more for lamps whose nominal lamp voltages are over 90 volts. The spike voltage should be less than 180 volts and practically less than 150 volts and preferably less than 100 volts for reliable starting. Plugging these voltages into the fitted equation, or reading the plot of FIG. 4, yields the following results: PV=82.7 torr-cc for 180 volt spike; PV=96.4 torr-cc for 150 volt spike; PV=135.8 torr-cc for 100 volt spike.

The design space for the discharge tube is further limited by the need to limit the voltage crest factor $V_{CF}$. It has been found that $V_{CF}$ of a new CDM lamp follows a curve that is inversely proportional to the product of the total pressure $P_{TOT}$ and the square of the inner diameter, as shown in FIG. 5. The equation for the curve is $V_{CF}=39616/P_{TOT}D^2+1.359$. In order for the lamp to run on existing HPS or other types of ballasts, to prevent flicker, and to promote long lamp life, $V_{CF}$ should be less than 1.7. Lamps will achieve a $V_{CF}$ of less than 1.7 if $P_{TOT}\ D^2>1.16\times10^5$ torr-mm$^2$. The total pressure can be calculated from the Hg dose and arc tube volume. The arc tube volume is computed for a cylinder having a diameter D and a length L using the formula $V=\pi LD^2/4$, a well known method for computing the volume of a cylinder. Assuming a parabolic temperature profile, the total pressure is $P_{TOT}=748\ Hg/V+8.87\ P_{xe}$, where 748 has the units cm$^3$-torr/mg, Hg is the dose in mg, V is in cm$^3$, and $P_{xe}$ is in torr. The last two equations can be designed to get a requirement for low $V_{CF}$ in terms of construction parameters:

$$9.524\times10^5\ Hg/L+8.87D^2P_{xe}>1.16\times10^5.$$

The data points in FIG. 5 are from lamps operated on CWA ballasts. The total pressures were calculated from known Hg doses, Xe fill pressures, and arc tube volumes.

The advantages of the CDM lamp according to the invention are that it provides a high efficacy (over 90 lm/W), white light (~4000° K. CCT, MPCD+/−10), and a high CRI (over 85) in a 200 W lamp. CCT is the correlated color temperature and MPCD is the minimum perceptible color difference, a measure of the color point from the black body line. The lamp also exhibits color stability and lamp-to-lamp color uniformity previously only enjoyed by lower wattage CDM lamps such as Mastercolor lamps (Mastercolor is a registered trademark of Philips Electronics North America Corporation). Additionally, the lamp is suitable as a retrofit for 200 W HPS S-66 ballasts.

BRIEF DESCRIPTION OF THE DRAWING

FIG. 6 is a table giving dimensions and performance parameters for three lamps according to the invention.

DESCRIPTION OF THE PREFERRED EMBODIMENTS

Figure 1:
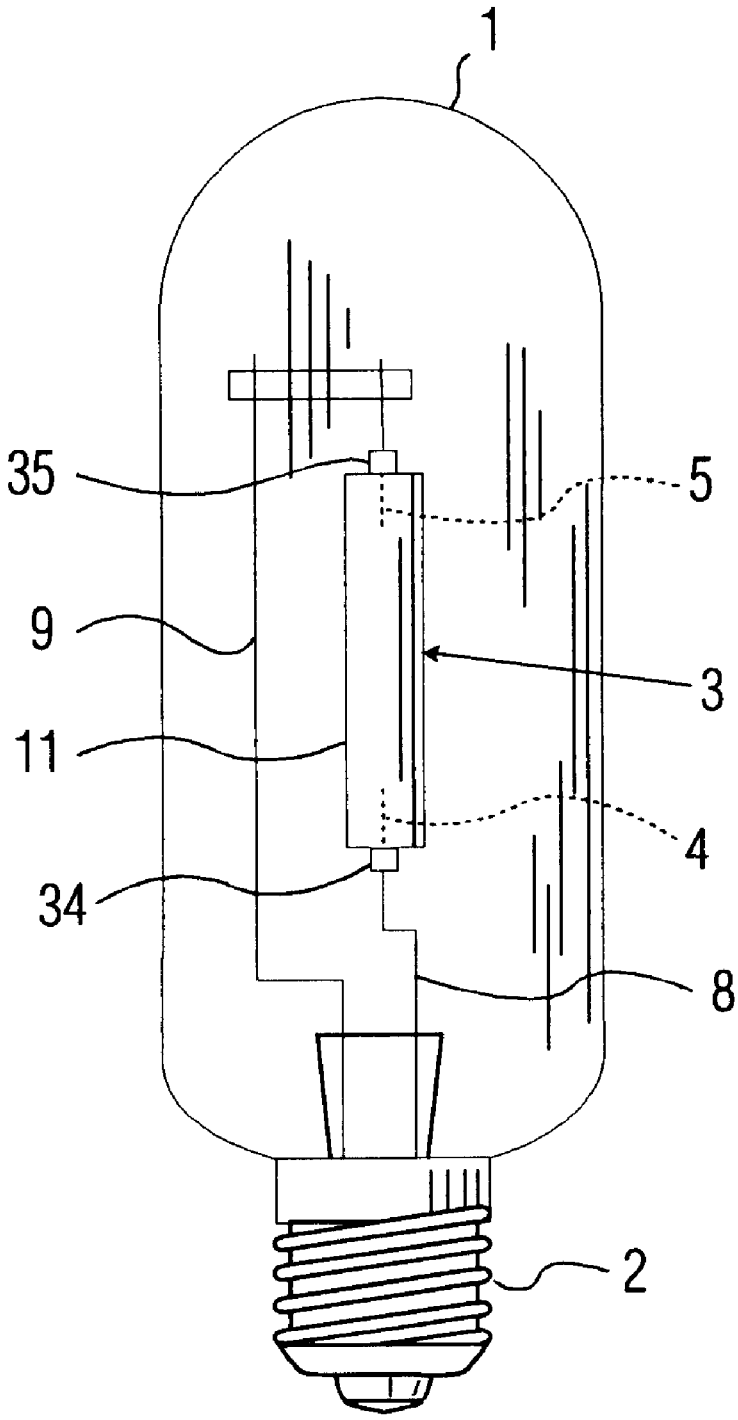
FIG. 1 is a diagrammatic elevation view of a lamp according to the invention.

FIG. 1 shows a metal halide discharge lamp provided with a discharge vessel 3 having a ceramic wall which encloses a discharge space 11 containing an ionizable filling. Electrodes 4, 5 extend through plugs 34, 35 and receive current from conductors 8, 9 which also support the discharge vessel 3. The vessel 3 is surrounded by an outer bulb 1 which is provided with a lamp cap 2 at one end.

Figure 2:
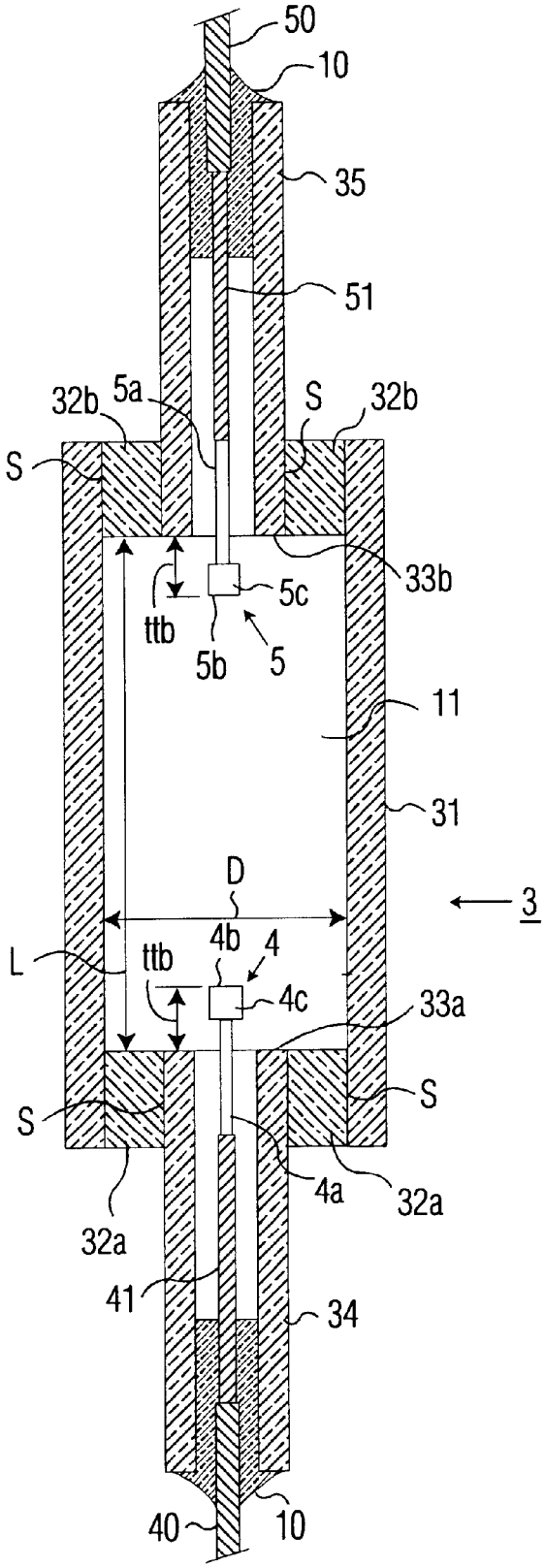
FIG. 2 is a diagrammatic axial section view of the discharge vessel in the lamp.

FIG. 2 shows the discharge vessel 3 in greater detail. The vessel includes a cylindrical wall 31 extending between end walls 32*a*, 32*b* in which the ceramic projecting plugs 34, 35 are fitted, each end wall portion 32*a*, 32*b* forming an end surface 33*a*, 33*b* of the discharge space. The end wall portions each have an opening in which the ceramic projecting plug 34, 35 is fastened in a gastight manner in the end wall portion 32*a*, 32*b* by means of a sintered joint S. The cylindrical wall has an internal diameter D, and the end walls are spaced apart by a distance L. The plugs 34, 35 receive current leads 40, 50 through ceramic melting joints 10, which provide a seal. The leads 40, 50 are niobium or other metal having a coefficient of expansion that corresponds to that of the end plugs 34, 35, and have halide resistant sleeves 41, 51, for example of Mo—$Al_2O_3$. Each of the electrodes includes a rod 4*a*, 5*a* connected to a respective lead, and a tip 4*b*, 5*b* fitted with a coil 4*c*, 5*c*. Each tip extends above the respective end wall 32*a* by a distance ttb.

The construction is described in greater detail in prior art patents such as U.S. Pat. No. 5,973,453 and U.S. Pat. No. 6,031,332. The present invention relates to the relationship between structural elements such as dimensions of the discharge vessel and pressure of the fill gas, and performance factors such as wall temperature, efficacy, and voltage crest factor.

Figure 3:
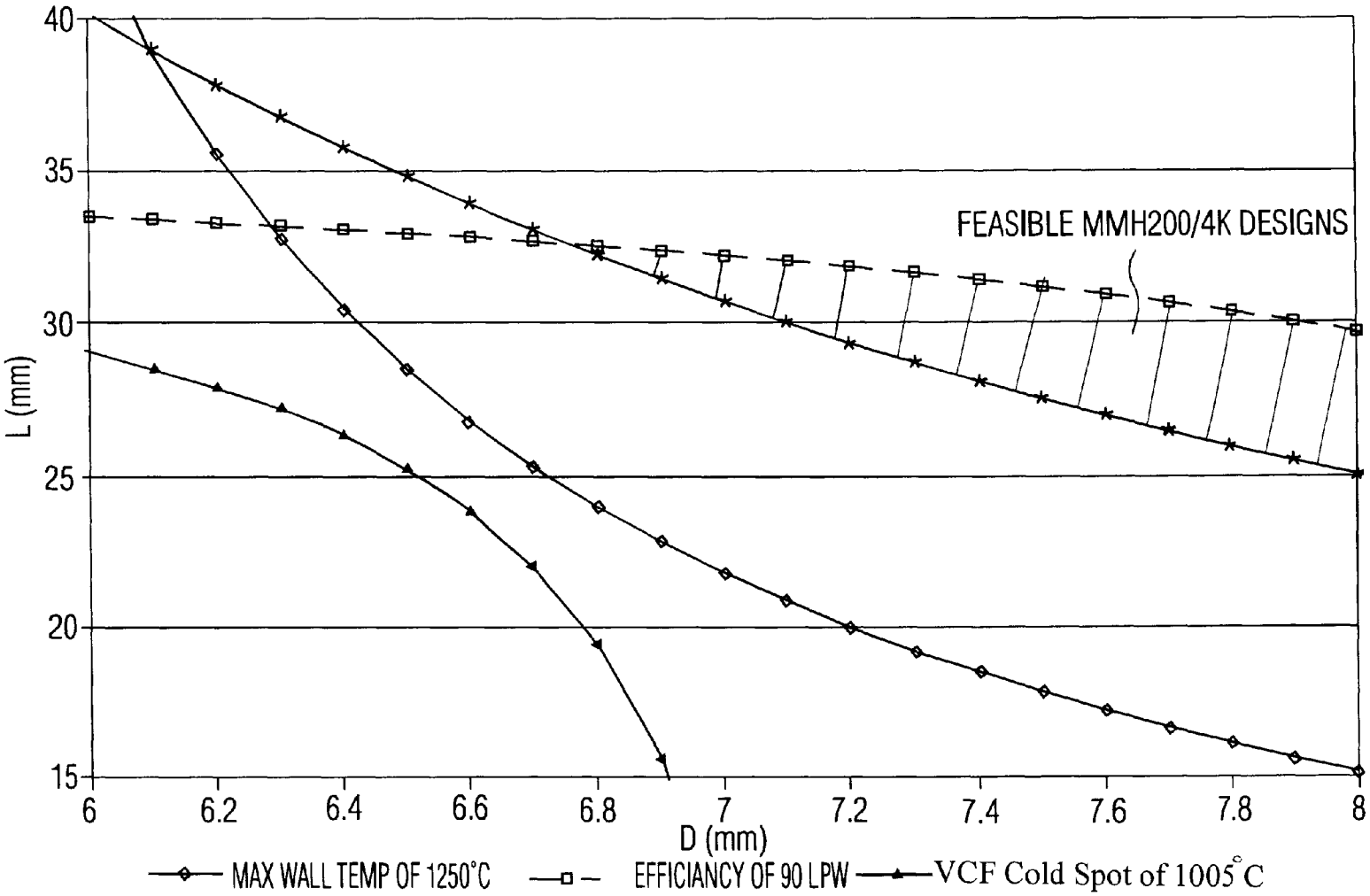
FIG. 3 shows plots of internal diameter vs. internal length of a discharge tube in a 200 W lamp, to achieve desired wall temperature, efficacy, voltage crest factor, and cold spot temperature.
Figure 4:
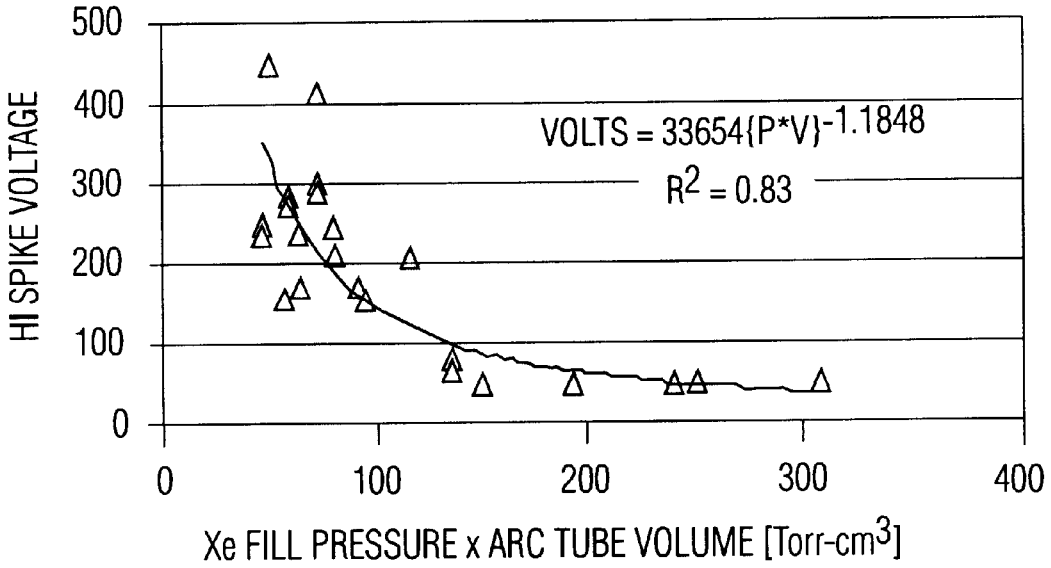
FIG. 4 shows a plot of hydrogen iodide spike voltage vs. PV.
Figure 5:
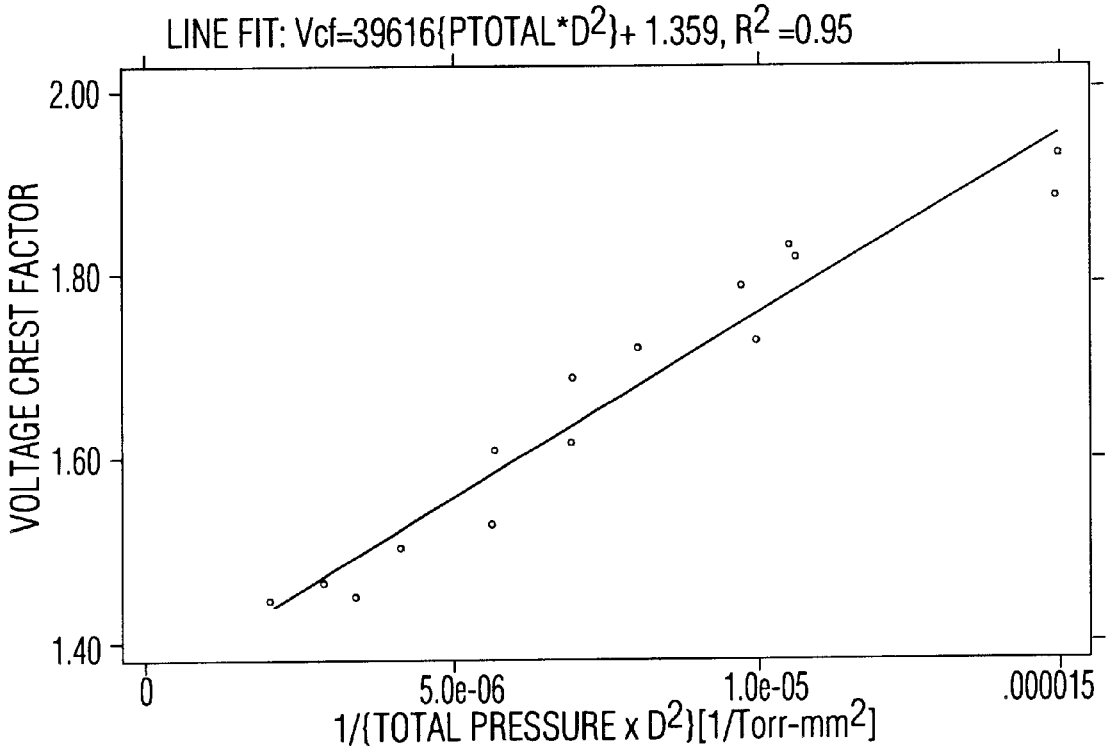
FIG. 5 shows a plot of voltage crest factor vs. $1/P_{TOT}D^2$.

According to a preferred embodiment of the CDM lamp according to the invention, the rated lamp power is 200 watts and the fill gas includes Xe with a cold fill pressure of 200 torr. Xenon is preferable to argon as an ignition gas because the atoms are larger and inhibit evaporation of the tungsten electrodes, so that the lamp lasts longer. The fill gas also includes Hg, NaI, and iodides of Tl, Dy, Ho, Tm, and Ca; the latter acts as a color adjuster. The design space was determined by the use of designed experiments and the characteristic equations for each design parameter. FIG. 3 shows the design space that was found for a 200 W CDM lamp. Four curves were plotted. The curve on the lower left represents a voltage crest factor $V_{CF}$ of 1.7, and the space above it represents lower $V_{CF}$'s. This is desirable because ballasts for HPS lamps have low sustaining voltages. The next curve represents a wall temperature $T_W$ of 1250° C., and the space above it represents lower wall temperatures. This is desirable because at higher temperatures the PCA is attacked by the salts and also evaporates, which darkens the outer envelope and shortens lamp life. Next are two intersecting curves which define the actual design space. One is the curve for a cold spot temperature of 1005° C.; the space above it represents lower temperatures. The other represents an efficacy of 90 lm/W; the space below it represents higher efficacies. The design space is limited by an inside diameter of 6.7 mm and an inside length of 33 mm (aspect ratio 4.9), and, at an inside diameter of 8 mm, lengths of 25 mm (aspect ratio 3.1) and 30 mm (aspect ratio 3.8). Longer lengths may be possible. The design space was determined by the use of designed experiments and the characteristic equations for each design parameter. FIG. 3 shows the design space that was found for a 200 W CDM lamp. Four curves were plotted. The curve on the lower left represents a voltage crest factor $V_{CF}$ of 1.7, and the space above it represents lower $V_{CF}$'s. This is desirable because ballasts for HPS lamps have low sustaining voltages. The next curve represents a wall temperature $T_W$ of 1250° C., and the space above it represents lower wall temperatures. This is desirable because at higher temperatures the PCA is attacked by the salts and also evaporates, which darkens the outer envelope and shortens lamp life. Next are two intersecting curves which define the actual design space. One is the curve for a cold spot temperature of 1005° C.; the space above it represents lower temperatures. The other represents an efficacy of 90 lm/W; the space below it represents higher efficacies. The design space is limited by an inside diameter of 6.7 mm and an inside length of 33 mm (aspect ratio 4.9), and, at an inside diameter of 8 mm, lengths of 25 mm (aspect ratio 3.1) and 30 mm (aspect ratio 3.8). Longer lengths may be possible.

The dimensions of the lamp and performance factors are summarized in the table of FIG. 6; there are two examples of the 200 W lamp, and an example of a 400 W lamp. The discharge vessel of the latter has dimensions and Xe cold pressures such that hydrogen iodide voltage spikes and the voltage crest factor are minimized. This makes it possible to operate the lamp on a 400 W HPS (high pressure sodium) S-51 ballast.

Figure 7A:
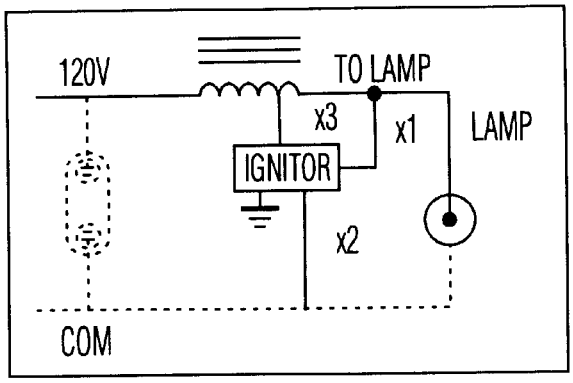
FIGS. 7A–7D are schematics of known magnetic ballasts which can be used with the lamp according to the invention.
Figure 7B:
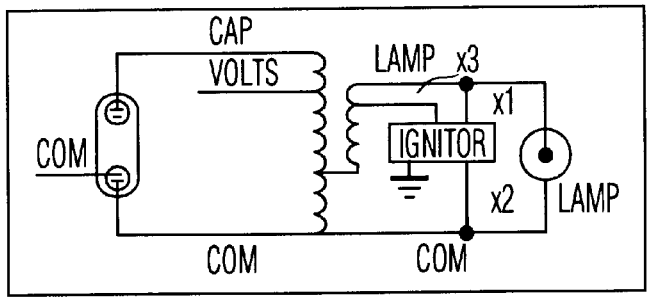
Figure 7C:
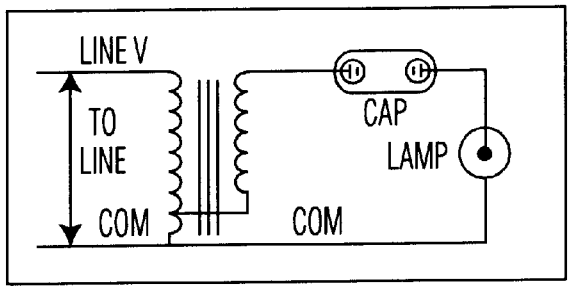
Figure 7D:
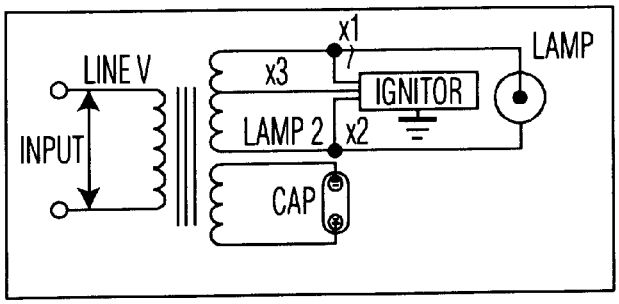

FIGS. 7A–7D are schematics of known ballasts with which the lamp according to the invention may be used. FIG. 7A shows a so-called "reactor ballast" which is common in Europe for low wattage (35–150 W) HPS lamps operating at 50 volts. In Europe, reactor ballasts are commonly used with a 230 volt supply voltage for all HPS lamp types with lamp voltages of about 100 volts. FIG. 7B shows a constant voltage auto-transformer (CWA) which is commonly used for high wattage HPS lamps; this is the ballast for which the lamp according to the invention has been primarily designed, so that it can replace an HPS lamp without replacing the ballast. FIG. 7C is a CWA commonly used for metal halide lamps. Both CWA's may be used with any line voltage, depending on where it is tapped. FIG. 7D shows a magnetically regulated ballast for either HPS or metal halide. It is a pulse start ballast which provides excellent regulation but is large, heavy, and expensive, hence not common.

The foregoing is exemplary and not intended to limit the scope of the claims which follow.

What is claimed is:

1. A metal halide lamp comprising a ceramic discharge vessel enclosing a discharge space, said discharge vessel having an internal length L, an internal diameter D, an aspect ratio L/D, and an internal volume $V=\pi LD^2/4$, a fill gas comprising xenon, mercury, sodium halide, and halide salts of metals selected from Tl, Dy, Ho, Tm, and Ca, said xenon having a cold fill pressure P, said fill gas having an operating pressure Ptot, and a pair of electrodes in said discharge space for sustaining a discharge in said fill gas, wherein said aspect ratio lies in a range from 3 to 5.

2. A metal halide lamp as in claim 1 wherein said lamp has a power rating of 200 watts, and wherein in a plot of L vs. D, the dimensions L, D are in mm and lie above a line defined by the points (32, 6.7) and (25, 8), and below a line defined by the points (32,6.7) and (30, 8).

3. A metal halide lamp as in claim 1 wherein the product PV of the cold fill pressure P and the volume of the arc tube V is greater than 96.4 torr-$cm^3$, whereby hydrogen iodide spikes during start-up are limited to a maximum of 150 volts.

4. A metal halide lamp as in claim 3 wherein the product PV is greater than 136 torr-$cm^3$, whereby hydrogen iodide spikes during start-up are limited to a maximum of 100 volts.

5. A metal halide lamp as in claim 1 wherein the product $Ptot \times D^2$ is greater than $1.16 \times 10^5$ Torr-$mm^2$, whereby said lamp has a voltage crest factor which is less than 1.7.

6. A metal halide lamp as in claim 1 wherein said discharge vessel comprises a pair of opposed endwalls and a cylindrical wall therebetween, said electrodes extending from said endwalls by a distance of less than 4 mm.

7. A metal halide lamp as in claim 1 wherein said lamp has a power rating of 200 watts and said discharge vessel has a wall thickness of less than 1.0 mm.

8. A metal halide lamp as in claim 1 wherein said gas fill consists essentially of xenon, mercury, sodium halide, and halide salts of metals selected from the group consisting essentially of Tl, Dy, Ho, Tm, and Ca.

9. A metal halide lamp as in claim 1 wherein said group further comprises Ce and Li.

10. A metal halide lamp as in claim 1 wherein said lamp has an operating voltage of 80 to 120 volts.

* * * * *